US006785394B1

(12) United States Patent
Olsen et al.

(10) Patent No.: US 6,785,394 B1
(45) **Date of Patent: *Aug. 31, 2004**

(54) TIME CONTROLLED HEARING AID

(75) Inventors: Henrik Bagger Olsen, København (DK); Nikolai Bisgaard, Lyngby (DK)

(73) Assignee: GN ReSound A/S, Taastrup (DK)

( * ) Notice: Subject to any disclaimer, the term of this patent is extended or adjusted under 35 U.S.C. 154(b) by 393 days.

This patent is subject to a terminal disclaimer.

(21) Appl. No.: 09/597,533

(22) Filed: Jun. 20, 2000

(51) Int. Cl.[7] ..... H04R 25/00
(52) U.S. Cl. ..... 381/312; 381/315; 381/323
(58) Field of Search ..... 368/63; 340/309.15; 381/60, 312, 315, 323, 328

(56) References Cited

U.S. PATENT DOCUMENTS

| | | | | |
|---|---|---|---|---|
| 4,049,930 A | * | 9/1977 | Fletcher et al. | 381/60 |
| 4,777,474 A | * | 10/1988 | Clayton | 381/312 |
| 4,821,247 A | * | 4/1989 | Grooms | 368/63 |
| 4,972,487 A | | 11/1990 | Mangold et al. | |
| 5,210,803 A | | 5/1993 | Martin et al. | 381/315 |
| 6,008,720 A | * | 12/1999 | Hongu et al. | 340/309.15 |
| 6,320,969 B1 | * | 11/2001 | Killion | 381/323 |

FOREIGN PATENT DOCUMENTS

| | | |
|---|---|---|
| WO | WO 00/41440 | 12/1999 |

OTHER PUBLICATIONS

N. Bisgaard, "Internet notice, open for inspection on Jul. 9, 2000, and is still pending" printed Jan. 3, 2002.

* cited by examiner

*Primary Examiner*—Suhan Ni
(74) *Attorney, Agent, or Firm*—Michael J. Bolan; Bingham McCutchen LLP

(57) ABSTRACT

A method and apparatus is provided for a hearing aid capable of determining its accumulated utilization time and making use of this information to control one or more of its functions. The control of the hearing aid's function may be obtained through alteration of parameters of a signal processing algorithm of the hearing aid or by execution of a particular transducer adjustment subroutine or algorithm. The accumulated utilization time may furthermore be utilized to provide a function that makes the hearing aid inoperative when a value of the accumulated utilization time matches some predetermined criteria, such as a predetermined limit value. Such a function is highly desirable if the hearing aid is sold in connection with a subscription arrangement between a dispenser and a hearing aid user where the user pays for his or her hearing aid through payment of regular renewal fees.

37 Claims, 2 Drawing Sheets

TIME CONTROLLED HEARING AID

BACKGROUND OF THE INVENTION

A hearing aid with data logging capability is disclosed in U.S. Pat. No. 4,972,487 in the form of a digitally programmable hearing aid that includes a data logging circuit and provides a number of different user-selectable listening programs. The data logging circuit is utilised to record log-data relating to how many times the user switches between the listening programs and a utilisation time of each of the listening programs. The recorded log-data are stored in a battery backed-up RAM area of a hearing aid signal processor so that the logged-data are retained when the normal hearing aid battery supply is interrupted. A bi-directional serial programming interface is furthermore included in the disclosed hearing aid making it possible for a host programming system, typically located in a dispenser's office, to read and display the logged-data. Thereby, the dispenser or audiologist can be informed about the hearing aid user's listening program usage from the initial fitting of the aid until the logged data are read out. This data-logged information may be used by the dispenser to optimise the selection of listening programs included in the hearing aid as well as determining optimal signal processing parameters for the listening programs.

For several reasons, that will be described in the following with reference to a number of embodiments of the present invention, it would be advantageous to allow a hearing aid processor or controller to automatically control a function or functions of the hearing aid based on a comparison between some predetermined criteria and the value of the accumulated utilisation time. Thus, a user equipped with the present hearing aid may have the aid's acoustic gain and/or frequency response automatically adjusted in accordance with various predetermined rules that are based on the aid's accumulated utilisation time value. In one embodiment of the present invention, the accumulated utilisation time value is utilised to control the time at which the hearing aid becomes inoperative by comparing the accumulated utilisation time value with a predetermined limit value and muting the processed output signal once this limit value is reached or exceeded. This embodiment of the invention is particularly useful if the hearing aid is sold in connection with a subscription arrangement. For the hearing aid user's convenience, a distinct notification signal is preferably provided to the user at a predetermined time period prior to the hearing aid becomes inoperative.

Hearing aids or instruments have traditionally been sold to users or patients as a one-time service at a relatively high price that also would have to cover the dispenser's obligation to service the hearing aid user with hearing aid adjustments, repairs and general advice about proper use of the acquired aid. Such a service obligation usually runs for a 3–5 years period while repairs are covered by a guarantee in the first 1–2 years.

As an alternative, it would be desirable if the hearing aids could be sold in connection with subscription arrangements, much in the same way as contact lenses are sold today, where a start fee is paid upon an establishment of a subscription agreement and where regular, e.g. monthly, subscription fees are paid afterwards to cover on-going services provided by the contact lens provider.

For a hearing aid dispenser, a similar arrangement would have the advantage that it provided a source of continuous income. For the hearing aid user, an advantage would be that the relatively high cost of purchasing the hearing aid could be distributed over a period of several years. Another advantage for the hearing aid user could be that he/she could be ensured that repairs and other service of the hearing aid would be carried out if the regular subscription fees were paid. However, to make such arrangements feasible to the hearing aid dispenser, he must be provided with a possibility of terminating his services and making the hearing aid inoperative if the user neglects his/hers contractual obligations, much in the same way as a contact lens provider can cancel his deliveries if e.g. proper fees are not paid.

To make such a prescription arrangement practical, it would therefore be highly desirable to provide a hearing aid that was capable of automatically interrupting its operation after expiration of a predetermined accumulated utilisation time period which may have been fixed in the subscription agreement.

SUMMARY OF THE INVENTION

One object of the invention is to provide a hearing aid that comprises time recording means adapted to determine the accumulated or summed-up utilisation time of the hearing aid in order to control one or several functions of the hearing aid based on a comparison between the accumulated utilisation time value and predetermined criteria.

Another object of the invention is to provide a hearing aid particularly well suited for subscription arrangements between the dispenser and hearing aid users because the hearing aid may be adapted to detect when the subscription period expires and thereafter automatically enter an inoperative state.

DESCRIPTION OF THE INVENTION

A first aspect of the invention relates to a hearing aid comprising:

- a microphone adapted to generate an input signal in response to receiving acoustic signals,
- a processor adapted to process the input signal to generate a processed output signal,
- a system clock generator adapted to generate a system clock signal,
- a sound transducer for converting the processed output signal into an acoustic output signal, and
- time recording means adapted to detect utilisation time periods of the hearing aid based on the system clock signal or a clock signal derived from the system clock signal. Wherein the time recording means are adapted to determine an accumulated utilisation time value based on the detected utilisation time periods and compare the accumulated utilisation time value to one or several predetermined criteria to control a function of the hearing aid.

The hearing aid may be any conventional type of hearing instrument or aid such as a Behind The Ear (BTE), In The Ear (ITE) or Completely In the Canal (CIC) hearing aid. The input signal generated by the microphone may be an analogue signal or a digital signal, in a multi-bit format or a single bit format. The input signal to the processor is preferably provided as a digital signal so if the microphone signal is in an analogue form, it must be converted into a digital signal by a suitable analogue-to-digital converter (A/D converter) included on an integrated circuit of the hearing aid. The input signal may be subjected to various signal pre-processing such as amplification/buffering and/or bandwidth limiting before being applied to the A/D converter and subjected to other processing after conversion such as decimation, delaying etc. before the input signal is provided to the processor.

The sound transducer that converts the processed output signal into an acoustic output signal may be a conventional hearing aid speaker often called a "receiver" or another sound pressure transducer producing a perceivable acoustic signal to the user of the hearing aid.

The processor which is adapted to process the input signal may comprise one or several separate processors and its/their associated memory circuitry, either arranged on a single integrated circuit or distributed over several respective integrated circuits.

The processor may comprise an analogue signal processor operating on an analogue or continues time input signal, or a sampled input signal, provided by the microphone. The analogue signal processor will usually operates in accordance with one or more adjustable signal processing parameters to provide a processed output signal that is tailored to specific characteristics of a patient's hearing loss. The processor may, alternatively, be constituted by, or at least comprise, a Digital Signal Processor (DSP). Such a DSP based hearing instrument must furthermore comprise an analogue-to-digital converter adapted to receive and convert the input signal to a digital signal. The DSP may be adapted to receive the system clock signal, or a clock signal derived from the system clock signal and to receive and process the digital signal in accordance with a predetermined signal processing algorithm to provide a digital output signal. To convert the digital output signal back to a continues time signal that can be applied to the sound transducer, a digital-to-analogue converter adapted to generate the processed output signal based on the digital output signal must be utilised. The digital-to-analogue converter preferably comprises a Pulse Width Modulator or a Pulse Density Modulator since these modulator types are well suited to directly convert the digital output signal into a continuous time signal in the form of a coded bit stream directly applicable to the sound transducer.

The DSP may comprise, or be constituted by, a proprietary or commercially available fixed or floating point DSP core. The DSP may be a software programmable type applying one or several different signal processing algorithms to the input signal in accordance with one or several respective sub-routines held in an associated program RAM during execution of the algorithms. Furthermore, the several different signal processing algorithms may be provided as, or grouped into, respective pre-set listening programs which the user may be able to switch between in accordance with his/hers preferences and/or characteristics of the user's current listening environment. The DSP may also be constituted by, or at least comprise, a hard-wired DSP designed to execute one or several fixed signal processing algorithm (s) in accordance with respective fixed set of instruction(s) from an associated logic controller in such a hard-wired DSP architecture, the program RAM area is not required but algorithm parameters and other data variables must still be stored in e.g. register files and/or data RAM during execution of the fixed signal processing algorithm(s).

To retain the different signal processing algorithms of the software programmable DSP when the hearing aid's normal voltage supply source, typically a 1.3–1.5 Volt Zinc-Air battery, is interrupted or discharged, the sub-routine(s) must be (semi-) permanently stored in a memory area capable of retaining data during such power supply interruptions. This may be accomplished by storing the sub-routine(s) within one or more non-volatile memory devices such as EPROM, EEPROM and Flash-memory devices. A non-volatile memory device may be provided as a separate integrated circuit communicating with the DSP over a suitable, typically serial, programming interface or the non-volatile memory device may be integrated with the DSP to provide a single chip solution. An alternative way of providing the retained memory area could be to utilise volatile memory types such as RAM or register files and supply these from a back-up power supply source, such as a back-up battery or a supercharge capacitor, of sufficient capacity to retain data during the interruptions of the normal voltage supply source.

Irrespective of whether hearing aids according to the present invention comprise an analogue signal processor or a DSP, the signal processing parameters, which controls the processing of the input signal, are preferably calculated on a host programming system in response to previously entered audiometric data of the user or patient so as to optimise the parameter values to specific characteristics of each patient's hearing loss.

In embodiments of the invention that utilise the analogue signal processor, the time recording means preferably comprise one or several utilisation time counter(s) and a digital controller operated in response to the system clock signal or a clock signal derived from the system clock signal. The digital controller may be adapted to determine the accumulated utilisation time value and compare this value to the one or several predetermined criteria to determine whether they match. If such a match is found, the digital controller may subsequently provide the control of the pertinent function of the hearing aid. Alternatively, the time recording means may be based on determining consecutive discharge sequences of a capacitor voltage. The capacitor charging may be based on a constant current source delivering a small substantially constant charging current, such as 20 nA to 20 $\mu$A, to the capacitor and by sampling the capacitor voltage, e.g. by a appropriate A/D-converter, the utilisation time periods may be determined by counting the number of discharge sequences.

If a DSP is included in the processor, the time recording means are preferably fully or at least partly integrated with the DSP. Thereby, the detection of the utilisation time periods, the determination of the accumulated utilisation time value, its comparison to the predetermined criteria and the control of the pertinent function may be implemented by a dedicated set of DSP instructions, e.g. a dedicated sub-routine, in combination with one or several associated general purpose registers or counters of the DSP. By applying this methodology, a relatively small and simple software routine operating on already existing hardware resources of the DSP may be utilised to provide the desired time control of the function of the hearing aid. Alternatively, a small separate software controlled or hard-wired co-processor, customised to perform the above-mentioned operations of the time recording means, could be integrated on the same integrated circuit as the DSP. This arrangement may be advantageous because the DSP is relieved from computing tasks associated with the utilisation time detection and control. Consequently, all computing resources of the DSP can be devoted to the processing of the input signal.

The frequency of the system clock will typically be located between about 50–200 kHz or between 1–5 MHz for analogue and DSP based hearing aids, respectively, while the accumulated utilisation time value may represent time periods of several hours or even hundred of hours. Therefore, a clock divider may be inserted before, or integrated within, the time recording means to provide a clock signal of reduced frequency so as to set a practical time resolution for the utilisation time counter(s) or registers representing the utilisation time periods or the accumulated utilisation time value. The practical time resolution for the utilisation time counter(s) may also be provided by employing several cascaded utilisation time counters where only the value of the last counter of the cascade is used to represent the accumulated utilisation time. The utilisation time counter(s) or register(s) may be located in a part of the time recording means without any back-up power supply source. Consequently, when the normal voltage supply source is interrupted, the values of these counter(s) or registers are lost. In such embodiments of the invention, the time recording means are preferably adapted to write the value(s) of the utilisation time counter(s) or register(s) to a retained memory area for permanent storage at predetermined time intervals. During operation of the hearing aid, the stored counter or register value(s) accordingly continuously monitor and track the current utilisation time, i.e. the utilisation time since the most recent power-up of the hearing aid.

Utilisation time counter values representing successive utilisation time periods may be stored at respective memory locations in the retained memory area so that each time the hearing aid is powered on, utilisation time counter values representing the present utilisation time period of the hearing aid are written to a new memory location, i.e. different from the one used for the previous utilisation time period. Obviously, the retained memory area may be required to store a relatively large amount of data if such a methodology is applied. Assume that the hearing aid is powered on/off two times every day to generate two corresponding utilisation time counter values each day. The hearing aid is furthermore operated each day during a 3 months period. This will require storage of a total of about 180 utilisation time counter values in the retained memory area. In order for the time recording means to determine the accumulated utilisation time value and compare this value to the predetermined criteria, a summation of up to 180 different utilisation time counter values must be made in the time recording means. An alternative and preferred solution is therefore to compute and store an updated value of the accumulated utilisation time in the retained memory area at each of the predetermined time intervals during operation of the hearing aid so as to minimise memory consumption in the retained memory area. This latter solution also greatly simplifies the comparison between the accumulated utilisation time value and the predetermined criteria.

The accuracy to which the determined accumulated utilisation time value represents the real utilisation time of the hearing aid is mainly determined by a length of the regular time interval and the accuracy of the system clock generator. The accuracy of the system clock generator is preferably better than +/−10% and more preferably better than +/−5% to ensure that there exists a reasonable correspondence between e.g. the expiration time of the hearing aid (fixed in a subscription agreement) and the real, i.e. calendar time. Since, the hearing aid's the normal voltage supply source is interrupted at some unknown instant in time, e.g. between two successive updates of the accumulated utilisation time value, an estimate of the current utilisation time period will contain an error of a magnitude between 0–1 times the length of the regular time interval. The error will furthermore be evenly distributed within this interval (due to the random nature of the point in time where the user interrupts the normal power supply). Consequently, the accuracy of the stored accumulated utilisation time value can be improved by adding a half regular time interval to the stored accumulated utilisation time value each time the hearing aid is powered on.

If the retained memory area is located within an EPROM, EEPROM or flash memory device, it may furthermore be desirable to limit the total number of times that the accumulated utilisation time value and/or contents of the utilisation time counter(s) or register(s) are written to such memory devices, since the devices usually are able to withstand only a limited number of write operations, such as 10,000 or 100,000 write operations. Therefore, the regular time interval is preferably chosen from the range between 1–60 minutes or more preferably between 5–20 minutes. If the regular time interval is selected to 20 minutes and the hearing aid is used for 12 hours daily during an estimated 5 years lifetime, a total of about 66,000 write cycles or operations will be performed in the retained memory.

According to a preferred embodiment of the invention, the retained memory area storing the detected utilisation time periods and/or the accumulated utilisation time value is accessible to an external programming system over a data communication link. The data communication link preferably comprises a wired serial bidirectional data link to allow exchange of data between the hearing aid and the external programming system. Data representing the utilisation time periods and/or the accumulated utilisation time value are preferably reset-able by a reset data sequence provided by the external programming system. Thereby, for subscription arrangements, the dispenser is provided with a convenient method that allows him/her to renew the subscription period by resetting those data in the hearing aid that represent already consumed utilisation time periods and/or accumulated utilisation time when the hearing aid user has paid the required subscription fees. Naturally, modifying the one or several predetermined criteria of the hearing aid in an equivalent manner will be able to provide the same functionality, i.e. renewal of the user's subscription to his/hers hearing aid. It is furthermore desirable to provide a hearing aid wherein the utilisation time periods and/or the accumulated utilisation time value may be reset from a remote location to avoid that the hearing aid user has to visit the dispenser every time the hearing aid must be renewed which may be impractical. This may be accomplished by adapting the processor and/or the time recording means to detect and decode the reset data sequence from the input signal generated by the microphone. According to one such embodiment of the present invention, the external programming system is adapted to provide the reset data sequence to the hearing aid in the form of a coded acoustic signal. The coded acoustic signal is preferably provided as a Dual Tone Multi-Frequency (DMTF) signal that may be communicated between the dispenser and the hearing aid user's home by a conventional telephone connection or forwarded on a suitable audio carrier such as a tape, magnetic or optical disk etc. Alternatively, the reset data sequence may be transferred directly to a programming port of the hearing aid through an electronic data network, such as an Internet connection, between the dispenser and the hearing aid user's home.

In yet another embodiment of the invention, the reset data sequence is entered into the hearing aid the user himself by manipulating a small keypad or dedicated control button on the surface of the hearing aid. A particular code or sequence of operations is forwarded to the user in writing, e.g. by mail or e-mail, and the user subsequently enters this information by operating the means provided therefor on the hearing aid.

The one or several predetermined criteria may comprise a limit value or several limit values that each is compared to the accumulated utilisation time value by the time recording means. Such limit values is one way of representing the one or several predetermined criteria in a practical way in connection with the previously described subscription arrangements. A first and a second limit value could be stored in the retained memory area of hearing aids sold on such subscription arrangements and the hearing aids adapted to warn the user of an upcoming expiry of the subscription period by emitting a distinct audible notification signal when the accumulated utilisation time value matches the first limit value. Subsequently, the subscription period expires when the accumulated utilisation time value matches the second limit value and the hearing aid is made inoperative, e.g. by interrupting or muting the processed output signal. Alternatively, the hearing aid may be made inoperative by adapting the time recording means to control a semiconductor switch element disconnecting or connecting the processor's supply voltage. The user is accordingly given in advance notice or warning about the upcoming event. The advance time may be set by the difference between the first and second limit values and may, conveniently, be selected to about 12–36 hours to give the user reasonable time to take the steps necessary to renew his/hers subscription of the hearing aid.

To secure that the hearing aid is rendered inoperative whenever the accumulated utilisation time value matches the predetermined criteria, also after the normal voltage supply source has been turned off and then on again, the time recording means may be adapted to compare the accumulated utilisation time value with the one or several predetermined criteria during a power-on sequence or boot of the hearing aid to determine whether the processed output signal should be interrupted or not. If the predetermined criteria are constituted by a limit value so that the hearing aid is muted when the accumulated utilisation time value is equal or larger than the limit value, the hearing aid may as a part of its initialisation process compare the limit value to the current value of the accumulated utilisation time and immediately mute the processed output signal if this limit value is already exceeded.

The hearing aid is preferably adapted to enter a power saving operation mode after the processed output signal has been interrupted or muted caused by a match between the predetermined criteria and the accumulated utilisation time value to save battery power.

The one or several predetermined criteria may comprise one or several respective limit values for the accumulated utilisation time that each, after having been reached, is utilised to initiate a modification of the processing of the input signal. As an example, the hearing aid may be provided with 10 limit values spread out in some predetermined manner in the range from 20 to 200 hours of accumulated utilisation time and adapted to modify a parameter of a filter circuit or filter algorithm that processes the input signal each time a limit value is reached. By adapting such a methodology, the patient may be allowed to gradually get accustomed to a newly prescribed amplification scheme/processing strategy in his/hers hearing aid. Clearly, parameters affecting other characteristics of the predetermined signal processing algorithm, e.g. characteristics of one or several compressor(s), could also be altered in a similar manner.

In one embodiment of the present invention, the accumulated utilisation time value is utilised to control start and, optionally, stop points in time of an on-line calibration process which is applied to a set of omni-directional microphones of a directional hearing aid. The directional hearing aid comprises: a first microphone having a first frequency response and being adapted to generate a first microphone signal in response to receiving the acoustic signals, a second microphone having a second frequency response and being adapted to generate a second microphone signal in response to receiving the acoustic signals, and frequency response adjustment means receiving the first and second microphone signals and being adapted to adjust a frequency response difference between the first and second frequency responses based on the first and second microphone signals.

The frequency response adjustment means are preferably adapted to start minimizing the frequency response difference in response to a signal from the time recording means indicating that the accumulated utilisation time value matches the one or several predetermined criteria. As mentioned above, the stop times for the calibration process may be defined by a corresponding limit value or the calibration process may alternatively be stopped when a predetermined matching criteria for the frequency response difference is reached.

By applying this scheme, e.g. at regularly selected time intervals, good long-term microphone matching can be assured and ageing effects, that normally tend to make the first and second microphone frequency responses deviate during the life time of the directional hearing aid, can be compensated. This ensures that the directional hearing aid is provided with optimal directional characteristics during prolonged use of the aid not just initially after its manufacture. If the directional hearing aid is provided with a DSP and a retained memory area that can be written by the DSP, the frequency response adjustment means may comprise one or several filter parameters controlling the frequency response difference, and the frequency response adjustment means may be further adapted to store the one or several filter parameters in the retained memory area after a minimisation of the frequency response difference has been performed A relatively simple way to perform the minimisation of the frequency response difference is to determine the long-term average power or signal level of each microphone during normal use of the directional hearing aid and determine a gain constant, or multiplier, that must be applied to one of the microphone signals in order to equalise their signal level or power. In this way, only a single parameter has to be determined and stored to obtain the desired minimisation of the frequency response difference between the microphones. In a more elaborate matching scheme, the frequency response adjustment means may be adapted to perform the desired minimisation of the frequency response difference by calculating a number of filter parameters of a compensating filter circuit or filter algorithm applied to one of the microphone signals. The filter parameters may be determined so as to provide a amplitude and/or phase response of the compensating filter that minimizes the frequency response difference or at least makes the frequency response difference smaller than a predetermined target value.

A second aspect of the invention relates to a method of controlling a function of a hearing aid, the method comprising the steps of:

generating an input signal by a microphone of the hearing aid in response to receiving acoustic signals, processing the input signal by a processor to generate a processed output signal, generating a system clock signal, converting the processed output signal into an acoustic output signal by an electro-acoustic transducer, detecting utilisation time periods of the hearing aid based on the system clock signal or a clock signal derived from the system clock signal and determining an accumulated utilisation time value based on the detected utilisation time periods and comparing the accumulated utilisation time value to one or several predetermined criteria, controlling a function of the hearing aid in dependence of the comparison between the accumulated utilisation time value and the one or several predetermined criteria.

In order to facilitate correct determination of the accumulated utilisation time value over a period of several days or months, where the hearing aid user usually will interrupt the normal power or voltage supply of the hearing aid at a number of occasions, the method preferably comprises the further step of storing the detected utilisation time periods and/or the accumulated utilisation time value in a retained memory area; where the retained memory area is adapted to hold data during interruption of a normal voltage supply source of the hearing aid.

The method may furthermore comprise the step of determining and updating the accumulated utilisation time value in the retained memory area at regular time intervals, where the regular time interval may be chosen within the range from 1 to 60 minutes, or more preferably between 5–20 minutes such as about 10 minutes.

In a preferred embodiment of the present method, the retained memory area storing the detected utilisation time periods and/or the accumulated utilisation time value is accessible to an external programming system over a data communication link. The data link preferably makes it possible for the external programming system to reset the stored detected utilisation time periods and/or the accumulated utilisation time value.

The present method may comprise the step of: interrupting the processed output signal when the accumulated utilisation time value matches the one or several predetermined criteria. That method is particularly useful if the hearing aid is sold in connection with a subscription arrangement since it may utilised to render the hearing aid inoperative unless the user pays regular renewal fees. To save the hearing aid battery from unnecessary drainage the method may comprise the further step of: entering a power saving operation mode after the processed output signal has been interrupted.

A very useful embodiment of the present method comprises the step of altering the processing of the input signal in response to detecting that the accumulated utilisation time value matches the one or several predetermined criteria. Consequently, the characteristics of a signal processing algorithm, such as an amplitude or phase response of a filter algorithm, applied to the input signal may be gradually altered during a patient's use of the hearing aid.

For some of the functions of the hearing that may be controlled in accordance with the present invention, it may be desirable to give the hearing aid user an advance notification of an upcoming event, this is naturally particularly relevant if the hearing aid will be rendered inoperative after the event. Such an advance notification is preferably provided by generating a distinct audible notification signal to the user by the sound transducer at a predetermined time period prior to the control of the function of the hearing aid is performed.

According to one embodiment of the invention, good long-term matching of a pair of omni-directional microphones is ensured by a method that comprises the steps of: generating a first microphone signal in response to receiving the acoustic signals by a first microphone having a first frequency response and generating a second microphone signal in response to receiving the acoustic signals by a second microphone having a second frequency response. A frequency response difference or level difference between the first and second frequency responses is thereafter adjusted based on the first and second microphone signals in response to a signal from the time recording means indicating that the accumulated utilisation time value matches the one or several predetermined criteria. The adjustment of the frequency response difference is preferably adapted to minimise the frequency response difference between the first and second frequency responses to ensure optimum directional characteristics of a directional hearing aid that utilises this method. A directional input signal for the hearing aid's processor may be generated by subtracting a frequency response corrected first or second microphone signal from the other microphone's input signal as is well known in the art.

While the control of the function in the previously described embodiments of the invention has been based on a determination of the hearing aid's accumulated utilisation time, it may for some applications be more practical or advantageous to provide a hearing aid that is capable of detecting real or calendar time with a reasonable accuracy. Thereby, the previously mentioned subscription agreements could be based on a fairly accurate calendar time period, such as a period of one week or one month, rather than the accumulated utilisation time which may correspond to a relatively inaccurate calendar time period due to individual differences between the hearing aid users' utilisation patterns. In order to detect the calendar or real time in the hearing aid with a reasonable accuracy, there must be provided a mechanism that allows such calendar time to be detected by the hearing aid even when its normal voltage supply source is disconnected. The latter typically happens at least each night where the user often removes the hearing aid battery from its compartment.

A third aspect of the invention therefore relates to a hearing aid comprising:

a microphone adapted to generate an input signal in response to receiving acoustic signals, a processor adapted to process the input signal to generate a processed output signal, a sound transducer for converting the processed output signal into an acoustic output signal and time recording means being adapted to detect and record time based on a clock signal of a clock generator. A normal voltage supply source is operative to supply power to at least the processor during normal operation of the hearing aid while a secondary voltage supply is adapted to supply power to the time recording means during time periods where the normal voltage supply source is inoperative.

The secondary voltage supply may comprise one or several supply capacitor(s) such as so-called supercharge capacitor(s) of large capacitance, e.g. larger than 0.1 Farad or more preferably larger than 0.5 Farad or even more preferably larger than 1.0 Farad or larger than 3 Farad. The one or several supply capacitor(s) may furthermore be the sole source of power in the secondary voltage supply. Such a solely capacitor based secondary voltage supply may be able to supply current to the time recording means during interruptions of the hearing aid's normal voltage supply source, often a disposable Zinc-Air battery or a rechargeable battery type, and may therefore serve as the only power source for the time recording means during said interruptions. To minimise the required capacitor size(s) in the secondary voltage supply, the capacitor(s) is/are preferably operatively connected to the hearing aid's normal voltage supply source to allow the capacitor(s) to be fully recharged when the hearing aid is operative. Alternatively, the secondary voltage supply may comprise a back-up battery that supplies power to the time recording means during the interruptions of the normal voltage supply source.

A preferred embodiment of the hearing aid comprises in addition a supply switch being adapted to, in a conductive state, charge the secondary voltage supply from the normal voltage supply source during normal operation of the hearing aid. The supply switch is furthermore adapted to, in a non-conductive state, disconnect the secondary voltage supply from the normal voltage supply source during the time periods where the normal voltage supply source is inoperative. Consequently, the secondary voltage supply is electrically isolated from any leakage current that may be drawn by e.g. the processor or other circuits of the hearing aid to ensure that a charge on the supply capacitor(s) is substantially solely consumed by the time recording means.

The clock generator is preferably designed with a very low current consumption such as consumption of about 1–5 $\mu$A from 1.3 volt supply voltage to allow supply capacitor(s) of practical physical dimensions, for hearing aids, to supply power to the time recording means, preferably for a time period of at least 24 hours and more preferably for a time period of at least 48 hours such as a time period of one week. A simple ring oscillator type of clock generator with a dominating RC time constant, e.g. provided by a poly-resistor (R) and poly-poly capacitor (C), could be used to provide a simple and low power clock generator with a reasonably accurate oscillation frequency. Since the time resolution of the clock generator for most applications only need to be in the order of seconds, it is advantageous to design the oscillation frequency of the clock oscillator to the lowest practical value for a completely integrated design, i.e. a design without any external components. The oscillation frequency may therefore be positioned within a range of 1–100 kHz such as about 10 kHz. Values of R in a range of 1–10 MΩ and C within a range of 10–100 pF will accordingly be suitable.

To further enhance the clock oscillator's precision, the secondary voltage supply may comprise a voltage regulator that provides the clock oscillator with a substantially constant voltage independent of the discharge state of the supply capacitor(s) and/or variations of the normal voltage supply source. Likewise, the clock oscillator may comprise a trimming circuit that is capable of fine-tuning the clock oscillator's frequency to compensate for the inevitable production tolerances, e.g. wafer-to-wafer or lot-to-lot variations, on the clock oscillators' frequency. The time recording means may further comprise a number of cascaded clock dividers that provides a divided clock signal with frequency of about 1 Hz which is used to operate a real-time counter, e.g. a 32 bit counter, with a sufficient capacity to represent calendar time periods of up to about 5 years, i.e. about 43830 hours.

Since it is difficult to design very accurate and very low power time recording means, it may be advantageous to utilise the processor to compensate the recorded time period in accordance with a predetermined correction algorithm. Parameters for such a correction algorithm may be determined during the manufacturing of the hearing aid by a direct measurement of a deviation between a nominal and actual frequency of the clock oscillator. Furthermore, the influence of DC voltage variations in the secondary voltage supply, e.g. caused by the above-mentioned supply capacitor discharge, on the oscillation frequency may also be determined during the manufacturing and incorporated in the parameters of the correction algorithm or entered into a suitable look-up table. Such methods of compensating the recorded time period are particularly convenient to implement if the processor comprises a DSP, preferably a software programmable DSP. A dedicated subroutine executed on the DSP during normal operation of the hearing aid may be adapted to read the real-time counter and apply the correction algorithm to the value to determine a compensated recorded time period more closely representing the actual calendar time. The compensated recorded time period could regularly be stored in an EEPROM location during normal operation of the hearing aid and retrieved from the EEPROM location after powering-on the hearing aid.

If the time recording means are provided on a separate integrated circuit, the processor may be adapted to communicate with the time recording means so as to read the read the contents of the real-time counter through an asynchronous or synchronous serial interface. If the time recording means are integrated with the processor, the processor may read the contents of the real-time counter over an internal data bus provided therefore.

It is understood that the embodiments of the hearing aid described in claims 2–26 in accordance with the first aspect of the invention may have a corresponding embodiment in a hearing aid in accordance with claim 37, i.e. the third aspect of the invention. In particular, the time recording means may be adapted to compare a value of the recorded calendar or real time to a predetermined criteria in order to control a function or functions of the hearing aid.

BRIEF DESCRIPTION OF THE DRAWINGS

A preferred embodiment of the present invention in the form of a software programmable DSP based hearing aid is described in the following with reference to the drawings, wherein.

DETAILED DESCRIPTION OF A PREFERRED EMBODIMENT

In the following, a specific embodiment of a DSP based hearing aid according to the invention is described and discussed in greater detail. The present description discusses in detail only a software controlled operation of time recording means provided as an integral part of a DSP-core or kernel and its associated hardware resources.

To support low power and low voltage operation of the present DSP based hearing aid, logic gates and other digital circuits should preferably be implemented in a low threshold voltage CMOS process. Preferred processes are 0.5–0.25 $\mu$m CMOS processes with threshold voltages located in the range from about 0.5 to 0.8 Volts.

Figure 1:
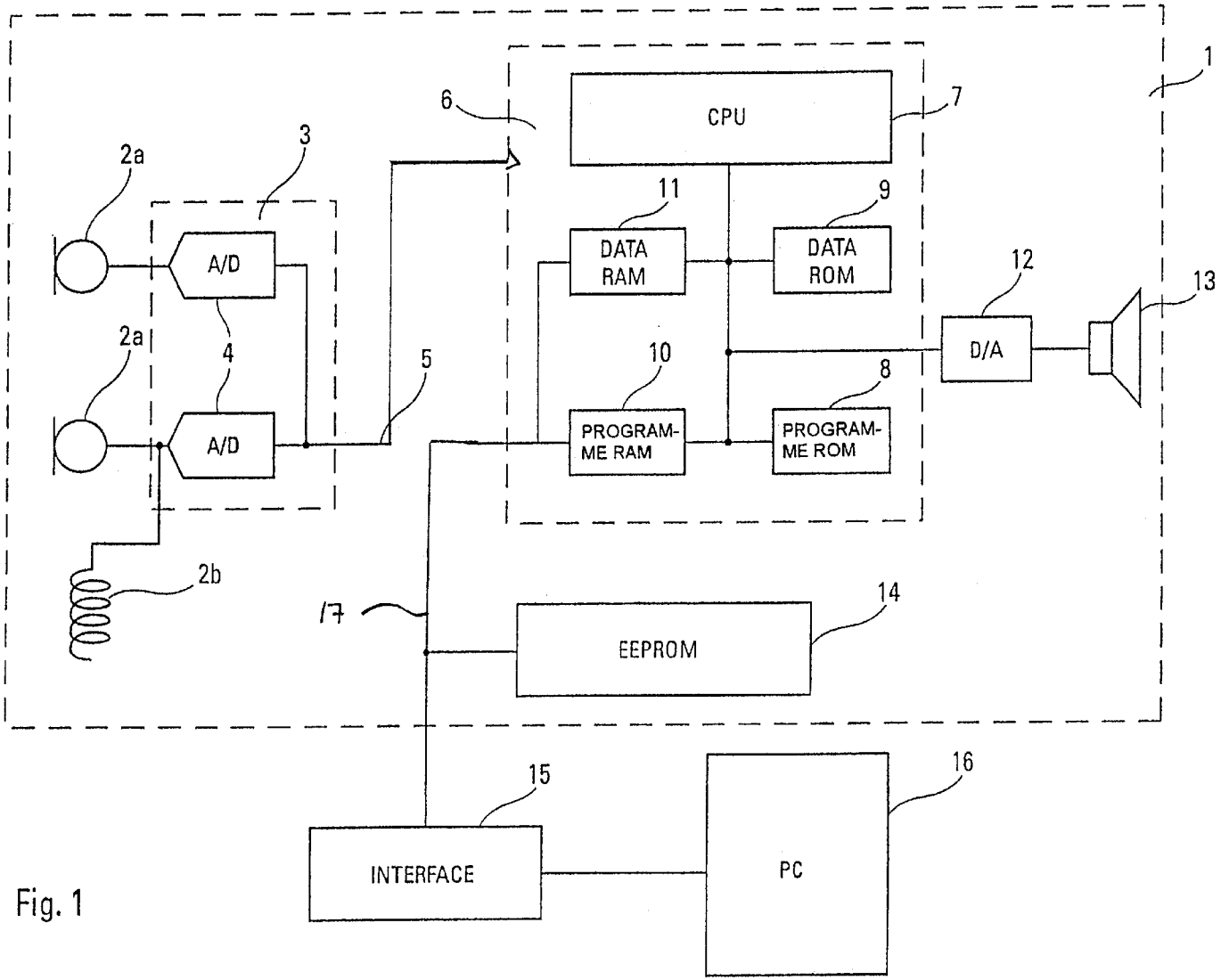
FIG. 1 shows a simplified block diagram of DSP based hearing aid according to the invention.

FIG. 1 is a simplified block diagram of a manually controllable directional/omni-directional hearing aid according to the present invention. The hearing aid includes time recording means adapted to determine an accumulated utilisation time of the hearing aid and to make the hearing aid inoperative after a pre-set limit value for the accumulated utilisation time has been reached. The use of two omni-directional microphones, 2*a* and 2*b*, respectively, provides a hearing aid capable of operating in an omni-directional mode or in a directional mode in accordance with a user's preference. In the simplified block diagram of FIG. 1, two conventional hearing aid microphones, 2*a* and 2*b*, respectively, are adapted to receive respective acoustic signals from a surrounding listening environment and to generate respective input signals for two low power synchronously operating analogue-to-digital converters 4 of the sigma-delta type. If the hearing aid is operated in omni-directional mode, only one of the analogue-to-digital converters needs to be active, the other can be shut down to save power. Each low power analogue-to-digital converter 4 is adapted to sample its input signal at about 1 MHz and perform a subsequent decimation to generate a 16 bit digital signal at a sample rate of about 16 kHz representing the respective analogue microphone signal.

The 16 bit digital signals from the two low power analogue-to-digital converters 4 are transmitted over a dedicated interface bus 5 to an integrated circuit 6 that comprises a proprietary Digital Signal Processor/CPU 7 and associated hardware resources including DATA RAM 11, a DATA ROM 9, a PROGRAM RAM 10 and a PROGRAMME ROM 8, all specially adapted to operate on supply voltages between 1.0–1.5 volts with a very low power consumption, i.e. in the order of 0.5–1.5 mW. The DSP 7 is adapted to receive and process the 16 bits digital signals provided over the interface bus 5 in accordance with a pre-stored software program executed from the PROGRAM RAM 10. This software program comprises a digital signal processing algorithm, adapted to process the microphone signal or signals in a manner that optimally compensates the individual user's hearing loss, and a sub-program or routine adapted to detect utilisation time periods and an accumulated utilisation time value of the hearing aid 1.

Figure 2:
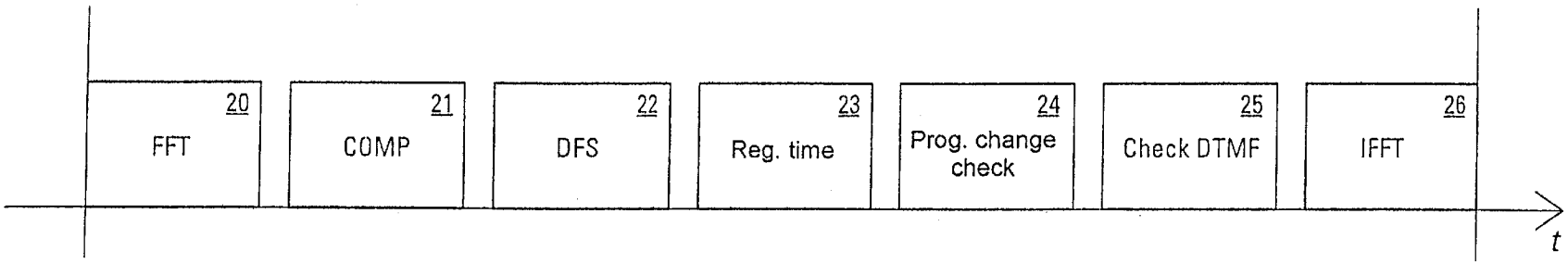
FIG. 2 illustrates a number of sub-routines, including a utilisation time sub-routine or program according to the invention, of a software program executed in the DSP based hearing aid.

The operation of this pre-stored software program will be described in more detail in connection with FIG. 2. A LC based master clock generator (not shown) integrated on the DSP 7 generates a master clock signal for the DSP 6. The DSP or CPU 7 may be directly clocked by this master clock signal or clocked by divided master clock signal. The DSP 7 is preferably clocked with a frequency of about 2–4 MHz.

The pre-stored software program is loaded from a PC based host programming system 16 to an internal non-volatile memory device, EEPROM 14 of the hearing aid 1 over a bi-directional serial interface 17. The EEPROM 14 is accordingly capable of retaining the pre-stored software program and various application specific data, which may have been written to the EEPROM 14 during normal operation of the hearing aid, during interruptions of the hearing aid's normal battery supply (not shown). When the normal battery voltage is applied to the DSP 7, a initial part of an OS boot routine stored in the programme ROM 8 ensures that an appropriate predetermined part of the EEPROM 14 is read in order to load or reload the pre-stored software program into program RAM 10 and thereby initialise the hearing aid 1 for normal operation. The interface box 15 between the host programming system 16 and the hearing aid 1 is preferably provided in the form of an industry standard Hi-Pro box.

After the hearing aid has been initialised, the DSP 7 generates a processed output signal to a digital-to-analogue converter 12 (D/A-converter) by converting successive 16 bit samples of the processed output signal into a corresponding Pulse Width Modulated signal that is directly applied across a pair of terminals of conventional hearing aid receiver or speaker 13 to generate an acoustic output signal which can be transmitted to the hearing aid user's eardrum.

The pre-stored software program is preferably adapted to execute a frame or block-oriented processing of the 16 bit digital signal or signals provided by the A/D converters 4. Each digital signal is grouped into successive, overlapping or non-overlapping, frames of suitable sizes, such as frames comprising about 56–128 samples. Each of these frames is thereafter subjected to a sequence of different sub-routines, 20–26 as illustrated in FIG. 2 where some of the sub-routines are adapted to process the 16 bit digital signal or signals from the A/D converters 4 while others are related to "house holding tasks" that take care of e.g. detecting the utilisation time periods and monitoring states of one or several user operated control buttons on the hearing aid 1.

The sub-routine 20 performs a Fast Fourier Transform (FFT) of the frame while a digital signal processing algorithm executed in sub-routine COMP 21 operates on the frequency domain representation of the frame to generate high resolution multi-band amplification and compression of one or both of the 16 bit digital signals from the A/D converters 4.

The programme or sub-routine DFS 22 performs a block oriented adaptive feedback cancellation algorithm on the frame and by calculating a compensation signal to suppress the effect of external or internal acoustic feedback signals that may arise by acoustic leakage between the user's earmold and the two hearing aid microphones, 2*a* and 2*b*.

The sub-routine Reg. time 23 performs a detection of the utilisation time periods of the hearing aid and determines an accumulated utilisation time value based on the detected utilisation time periods. The sub-routine furthermore compares the accumulated utilisation time value with a first and a second threshold or limit value that define two corresponding points in time where a audible notification signal should be generated and where the processed output signal should be interrupted, respectively. The dispenser is allowed to select limit values by entering his choices into a fitting module running on the PC of the host programming system 16. The first limit value may be conveniently set to about 1416 hours and the second limit value to 1440 hours so that the latter value corresponds to a 16 hours daily use of the hearing aid 1 during a 3 months prescription period. Other limit values may naturally be selected depending on the particulars of the prescription arrangement in question. An internal 32 bit data register (not shown) of the DSP 6 is preferably adapted to operate as a utilisation time counter keeping track of a current utilisation time period by increasing the counter value by one for each cycle of the pre-stored software program. Alternatively, a storage location in the data RAM 11 could be assigned to perform the counting task.

The cycle time of the pre-stored software program is defined by the number of samples in one frame and the sampling frequency of the 16 bit digital signal(s) from the A/D converter(s). If the block size is selected to 56 samples and the sampling frequency has been set to 16 kHz, the cycle time amounts to 3.5 milliseconds. Consequently, a utilisation counter value of 1,028,571 will correspond to a utilisation time period of 1 hour. The Reg. time sub-routine 23 is adapted to update a value of an EEPROM location that stores the value of the accumulated utilisation time of the hearing aid 1 every hour and to, subsequently, reset the utilisation time counter. However, many other, and smaller, time segments could be used for updating the accumulated utilisation time value, such as minutes, seconds, etc. in order to obtain a better time resolution or accuracy. The Reg. time sub-routine 23 could e.g. be adapted to reset the utilisation counter value every 15 minutes and record or update the accumulated utilisation time in the EEPROM memory location in segments of 15 minutes.

If the hearing aid is sold on the previously described subscription arrangement, the first and a second limit values are loaded into the hearing aid from the host PC 16 and stored in a dedicated EEPROM area. During execution of the Reg. time sub-routine 23, the value of the accumulated utilisation time in the EEPROM memory location is compared to the first and second limit values and if a match is determined an associated sub-routine is called to provide the required functionality, i.e. emission of a characteristic notification signal or an interruption of the processed output signal.

The sub-routine Prog. Change check 24 reads external input ports of the hearing aid to determine whether the user has activated one of the hearing aid's manual control buttons, such as a program selector button which changes between a number of pre-set listening programs or a microphone/telecoil selector button.

The sub-routine check DTMF 25 is adapted to analyse and test whether any of the 16 bit input signals of the two hearing aid microphones, 2*a* and 2*b* comprise a coded signal in the form of a Dual Tone Multi-Frequency (DMTF) signal. The computation of the FFT of the 16 bit input signals which already is performed in sub-routine 20 makes this analysis relatively simple. If valid DMTF signal is detected, the DSP 7 resets the internal 32 bit data register that holds the current utilisation time and the EEPROM location that contains the accumulated utilisation time value of the hearing aid. The hearing aid 1 has accordingly, been updated in a manner that allows it to operate for another subscription period. The DMTF signal may also comprise coded data that instruct the DSP to perform other tasks than solely resetting the accumulated utilisation time value in the EEPROM 14, such as changing parameters of the software program, in particular parameters of signal processing algorithms, or activating a particular pre-set listening program in the EEPROM 14.

If the prescription period expires, most of the processing performed by subroutines 20–26 is terminated and the processed output signal is muted so that the acoustic output signal from the receiver 13 is interrupted. To be able to reactivate the hearing aid 1 from a remote location if valid a DMTF signal is applied to one of the hearing aid microphones 2*a*, 2*b*, the FFT 20 and the check DTMF 25 subroutines are preferably still executed. Alternatively, the hearing aid 1 may be adapted to interrupt the processed output signal if the prescription period expires in a manner where even the FFT 20 and check DTMF 25 subroutines are halted. In such an embodiment of the invention, the user has to visit the dispenser that will be able to reactivate the hearing aid 1 by communicating with the aid over the serial programming interface 17 in order to reset/alter the accumulated utilisation time value.

What is claimed is:

1. A hearing aid comprising:

a microphone adapted to generate an input signal in response to receiving acoustic signals, a processor adapted to process the input signal to generate a processed output signal, a system clock generator adapted to generate a system clock signal, a sound transducer for converting the processed output signal into an acoustic output signal, time recording means adapted to detect utilization time periods of the hearing aid based on the system clock signal or a clock signal derived from the system clock signal, wherein the time recording means are adapted to determine an accumulated utilization time value based on the detected utilization time periods and compare the accumulated utilization time value to one or several predetermined criteria to control a function of the hearing aid.

2. A hearing aid according to claim 1, comprising:

an analogue-to-digital converter adapted to receive and convert the input signal to a digital signal, a Digital Signal Processor (DSP) adapted to receive the system clock signal and adapted to receive and process the digital signal in accordance with a predetermined signal processing algorithm to provide a digital output signal, a digital-to-analogue converter adapted to generate the processed output signal based on the digital output signal.

3. A hearing aid according to claim 1, wherein the time recording means are further adapted to store the detected utilization time periods and/or the accumulated utilization time value in a retained memory area, the retained memory area being adapted to hold data during interruptions of a normal voltage supply source of the hearing aid.

4. A hearing aid according to claim 3, wherein the retained memory area is located in a memory device selected from the group consisting of: (EEPROM, EPROM, RAM powered by a back-up voltage).

5. A hearing aid according to claim 3, wherein the time recording means are adapted to write an updated value of the accumulated utilization time value to the retained memory area at regular time intervals, whereby the accuracy of the accumulated utilization time value is determined by a length of a regular time interval.

6. A hearing aid according to claim 1, wherein the time recording means comprise at least one utilization time counter operated in response to the system clock signal or the clock signal derived from the system clock signal to provide a counter value representing one or several of the detected utilization time periods.

7. A hearing aid according to claim 5, wherein the regular time interval is a time interval between 5 minutes and 20 minutes.

8. A hearing aid according to claim 2, wherein the retained memory area storing the detected utilization time periods and/or the accumulated utilization time value is accessible to an external programming system over a data communication link.

9. A hearing aid according to claim 1, wherein the detected utilization time periods and/or the accumulated utilization time value are reset-able by a reset data sequence provided by an external programming system.

10. A hearing aid according to claim 9, wherein the time recording means are adapted to detect and decode the reset data sequence from the input signal generated by the microphone, the external programming system being adapted to provide the reset data sequence to the hearing aid in the form of a coded acoustic signal.

11. A hearing aid according to claim 1, wherein the one or several predetermined criteria comprise a limit value.

12. A hearing aid according to claim 2, wherein the DSP comprises a program RAM adapted to store the predetermined signal processing algorithm.

13. A hearing aid according to claim 2, wherein the time recording means forms part of the DSP.

14. A hearing aid according to claim 13, wherein the time recording means are at least partly implemented by predetermined set of DSP program instructions.

15. A hearing aid according to claim 14, wherein the predetermined set of DSP program instructions controls a counter value in at least one general purpose register of the DSP so as to represent the utilization time periods.

16. A hearing aid according to claim 1, wherein the processor is adapted to interrupt the processed output signal in response to a control signal from the time recording means indicating that the accumulated utilization time value matches the one or several predetermined criteria.

17. A hearing aid according to claim 16, further adapted to enter a power saving operation mode after the processed output signal has been interrupted.

18. A hearing aid according to claim 1, wherein the processor is adapted to alter the processing of the input signal in response to a control signal from the time recording means indicating that the accumulated utilization time value matches the one or several predetermined criteria.

19. A hearing aid according to claim 18, wherein a frequency response of a filter circuit processing the input signal is altered.

20. A hearing aid according to claim 1, wherein characteristics of one or several compressor(s) processing the input signal is altered.

21. A hearing aid according to claim 1, comprising:

a first microphone having a first frequency response and being adapted to generate a first microphone signal in response to receiving the acoustic signals, a second microphone having a second frequency response and being adapted to generate a second microphone signal in response to receiving the acoustic signals, frequency response adjustment means receiving the first and second microphone signals and being adapted to adjust a frequency response difference or level difference between the first and second frequency responses based on the first and second microphone signals, wherein the frequency response adjustment means are adapted to minimize the frequency response difference in response to a signal from the time recording means indicating that the accumulated utilization time value matches the one or several predetermined criteria.

22. A hearing aid according to claim 21, wherein the frequency response adjustment means comprises one or several filter parameters controlling the frequency response difference, and wherein the frequency response adjustment means are further adapted to store the one or several filter parameters in a retained memory area after a minimisation of the frequency response difference has been performed.

23. A hearing aid according to claim 1, wherein the time recording means are adapted to compare the accumulated utilization time value with the one or several predetermined criteria during a power-on sequence of the hearing aid to determine whether the processed output signal should be interrupted or not.

24. A hearing aid according to claim 1, wherein the time recording means are adapted to control a semiconductor switch element disconnecting or connecting a battery supply voltage to the processor in response to detecting that the accumulated utilization time value matches the one or several predetermined criteria.

25. A hearing aid according to claim 1, wherein the processor is adapted to generate a distinct notification signal at a predetermined time period prior to the control of the function of the hearing aid is performed, whereby a user of the hearing aid is given an audible notification about a upcoming change of function his/hers hearing aid.

26. A method of controlling a function of a hearing aid, the method comprising the steps of:

generating an input signal by a microphone of the hearing aid in response to receiving acoustic signals, processing the input signal by a processor to generate a processed output signal, generating a system clock signal, converting the processed output signal into an acoustic output signal by an electro-acoustic transducer, detecting utilization time periods of the hearing aid based on the system clock signal or a clock signal derived from the system clock signal, determining an accumulated utilization time value based on the detected utilization time periods and comparing the accumulated utilization time value to one or several predetermined criteria, controlling a function of the hearing aid in dependence of the comparison between the accumulated utilization time value and the one or several predetermined criteria.

27. A method of controlling a function of a hearing aid according to claim 26, further comprising the step of: storing the detected utilization time periods and/or the accumulated utilization time value in a retained memory area, the retained memory area being adapted to hold data during interruption of a normal voltage supply source of the hearing aid.

28. A method of controlling a function of a hearing aid according to claim 27, further comprising the step of: updating the accumulated utilization time value in the retained memory area at regular time intervals.

29. A method of controlling a function of a hearing aid according to claim 27, wherein the retained memory area storing the detected utilization time periods and/or the accumulated utilization time value is accessible to an external programming system over a data communication link.

30. A method of controlling a function of a hearing aid according to claim 29, wherein the detected utilization time periods and/or the accumulated utilization time value are resetable by an external programming system.

31. A method of controlling a function of a hearing aid according to claim 26, comprising the step of: interrupting the processed output signal when the accumulated utilization time value matches the one or several predetermined criteria.

32. A method of controlling a function of a hearing aid according to claim 31, comprising the further step of: entering a power saving operation mode after the processed output signal has been interrupted.

33. A method of controlling a function of a hearing aid according to claim 26, wherein the processing of the input signal is altered in response to detecting that the accumulated utilization time value matches the one or several predetermined criteria.

34. A method of controlling a function of a hearing aid according to claim 26, comprising the further step of: emitting a distinct audible notification signal from the sound transducer at a predetermined time period prior to the control of the function of the hearing aid is performed.

35. A method of controlling a function of a hearing aid according to claim 26, comprising the steps of:

generating a first microphone signal in response to receiving the acoustic signals by a first microphone having a first frequency response, generating a second microphone signal in response to receiving the acoustic signals by a second microphone having a second frequency response, adjusting a frequency response difference or level difference between the first and second frequency responses based on the first and second microphone signals in response to a signal from the time recording means indicating that the accumulated utilization time value matches the one or several predetermined criteria.

36. A method of controlling a function of a hearing aid according to claim 35, comprising the further step of:

minimizing the frequency response difference between the first and second frequency responses in response to the signal from the time recording means indicating that the accumulated utilization time value matches the one or several predetermined criteria.

37. A method of controlling a function of a hearing aid according to claim 36, comprising the further step of:

generating a directional input signal for the processor by subtracting a frequency response corrected first or second microphone signal from the other microphone signal.

* * * * *